United States Patent [19]

Simmen

[11] Patent Number: 4,457,034

[45] Date of Patent: Jul. 3, 1984

[54] IMPROVEMENTS RELATING TO THE MOISTENING AND SUBSEQUENT TEXTURING OF TEXTILE YARNS

[75] Inventor: Christian Simmen, Lichtensteig, Switzerland

[73] Assignee: Heberlein Maschinenfabrik AG, Wattwil, Switzerland

[21] Appl. No.: 278,468

[22] Filed: Jun. 29, 1981

[30] Foreign Application Priority Data

Jul. 9, 1980 [CH] Switzerland ..... 5238/80

[51] Int. Cl.[3] ..... D06B 1/08

[52] U.S. Cl. ..... 8/151.2; 8/158; 68/200; 118/420; 118/694; 427/434.6

[58] Field of Search ..... 8/151.2, 158; 68/200; 427/434.6; 118/420, 694; 28/248

[56] References Cited

U.S. PATENT DOCUMENTS

| | | | |
|---|---|---|---|
| 3,244,142 | 4/1966 | Walker | 68/200 X |
| 3,707,859 | 1/1973 | Carr et al. | 8/151.2 X |
| 4,096,611 | 6/1978 | Heyner | 68/200 X |

*Primary Examiner*—Philip R. Coe

*Attorney, Agent, or Firm*—Young & Thompson

[57] ABSTRACT

Textile yarn is led through the front face of a die 11, which is located on a moistening device 8, before being fed to the texturing jet 15. The die is fed from a pipe 7 leading from a moisture tank 1 and has an outlet aperture on its front face at the termination of an internal bore. The quantity of fluid fed to the tank 1 is so adjusted by means of a flow regulator 5, that a fluid level h is maintained in the tank, which corresponds to a throughput of fluid through the bore of the die 11 which is matched to the titre and the rate of flow of the yarn.

2 Claims, 3 Drawing Figures

Fig. 1
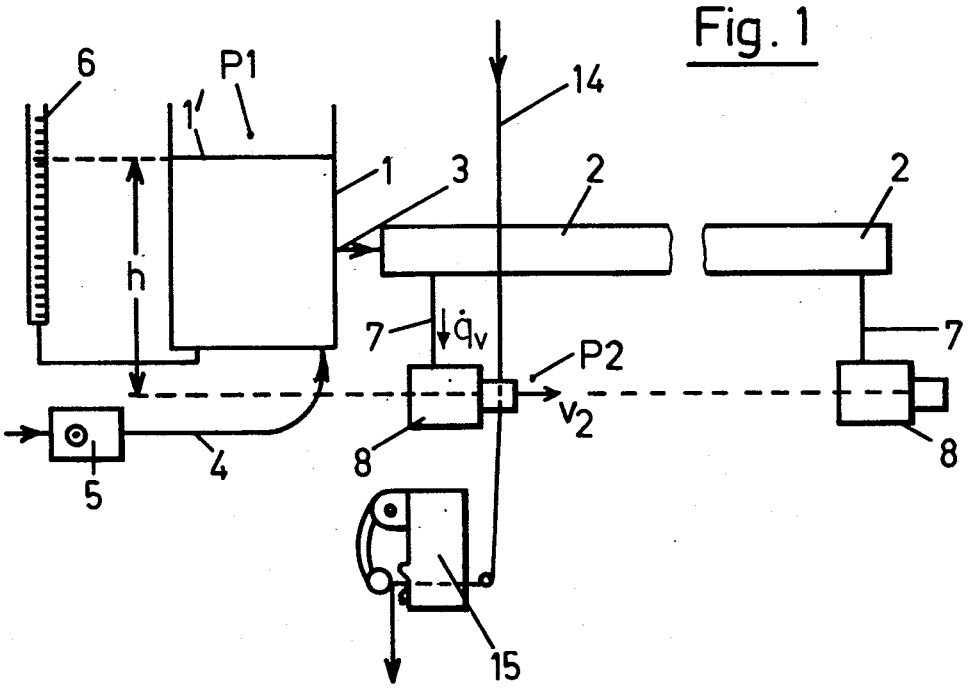
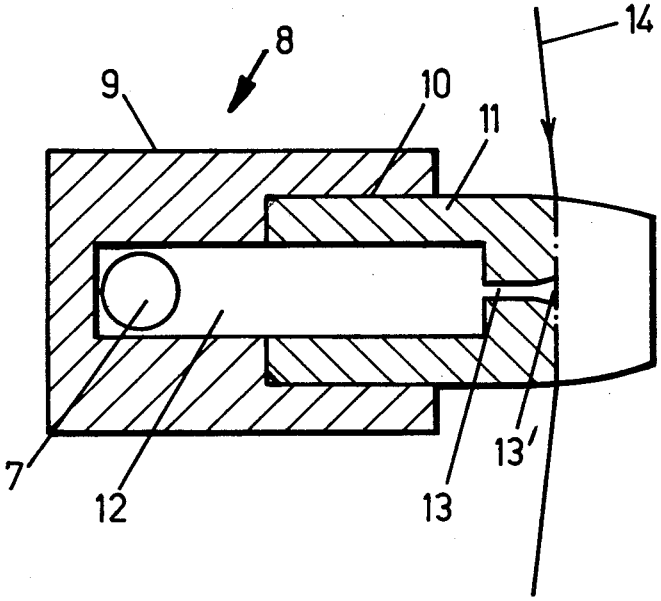
Fig 2
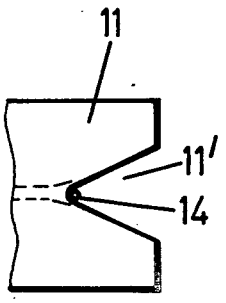
Fig 3

IMPROVEMENTS RELATING TO THE MOISTENING AND SUBSEQUENT TEXTURING OF TEXTILE YARNS

The invention relates to a process for moistening and then texturing textile yarns, for example multi-thread continuous filament yarns composed of synthetic material.

In a known process for moistening, and then texturing textile yarns by means of pressurised gas from a jet, the yarn, before being fed to the texturing jet, is led through the front face of a die. The die has a number of bores which are charged from a liquid tank and correspond to the number of yarns being treated. Each yarn runs through one of the bores and draws liquid out through the bore by a suction effect.

By this means, the absorption of excess water by the yarn is avoided, and the latter absorbs water only to such an extent that the interspaces between the individual filaments of the yarn are filled with water. The formation of a jacket of water round the yarn is thereby avoided, so that the problems of cleansing or removal of excess water from the yarn before it enters the texturing jet are avoided.

The liquid level in the liquid tank is of such a height that the liquid flowing into the bores in the die is maintained at a relatively low static partial vacuum which is dependent upon the mode and speed of conveyance of the yarn and will usually reach between 10 and 100 water column mm.

As is well known, standard texturing machines have a large number of adjacent yarn treatment points which are combined into individual divisions. For example, one machine may have 9 divisions, each with 8 treatment points, i.e. 72 treatment points altogether. It has been a practice to locate, at each division, a liquid tank with a standard device controlled by means of a float in order to regulate the level of the liquid, from which tank inflow pipes of equal length lead to the individual moistening devices.

By this means, it has been possible to feed an identical quantity of water to the yarns passing through the eight treatment points of each division, and the individual divisions have been matched to each other by calibrating the devices in order to regulate the liquid level. However, it has been possible only to match the quantity of water fed to the yarns to the yarn titre within a limited range. For this reason, it has been a practice to incorporate, in each moistening device, a stopcock by means of which the water fed to the bore in the die could be matched accurately to the yarn titre. Apart from the fact that the incorporation of such stopcocks is very costly and setting them at each treatment point requires a considerable amount of time, it has been shown that relatively small quantities of dirt in the water lead to partial clogging of the stopcock, a fact which uncontrollably influences the quantity of water which is fed to the yarns at the various treatment points.

Accordingly, this invention provides a process for moistening a textile yarn prior to texturing of the yarn by means of pressurised gas from a jet, wherein a moistening device is charged from a liquid tank, the moistening device comprising a die with a longitudinal bore past whose outlet aperture in the front face of the die the yarn is led, the quantity of fluid fed to the tank being so regulated by means of a flow regulator that a fluid level is maintained in the tank which corresponds to a throughput of fluid through the bore of the die which is matched to the titre and the speed of passage of the yarn.

Preferably, the liquid level in the tank is maintained at a height of at least 30 mm.

When carrying out such a process, the throughputs of liquid through the bores in the dies of the moistening devices at all the treatment points of the texturing machine can be reasonably accurately matched to the titre and rate of flow of the yarn being treated, from a single central point, that is to say, from the regulating device for feeding the fluid to the tank. The same effect can be achieved as with the costly incorporation of stopcocks in the individual moistening devices without the drawbacks of loss of time in adjusting the stopcocks at all the treatment points and the possibility of clogging of the stopcocks by dirt borne along in the water.

Apparatus for practicing the present method, for moistening textile yarn prior to passage of the yarn to a pressurised gas texturing jet, comprises a liquid tank and a moistening device comprising a die with a longitudinal bore connected to the tank outlet, and having a flow regulator located in the liquid inflow pipe to the tank.

In the preferred embodiment the longitudinal bore of the die has a length of up to 15 mm and a diameter of 0.5 to 1.5 mm. It is also preferred that the longitudinal bore in the die open out conically towards the liquid outlet aperture.

The invention may be performed in various ways and one preferred embodiment thereof will now be described with reference to the accompanying drawings, in which:

FIG. 1 is a diagrammatic illustration of the side view of the device according to the invention;

FIG. 2 is a longitudinal central cross-section of a moistening device of FIG. 1 on an enlarged scale; and FIG. 3 is a side view of a detail of FIG. 2.

FIG. 1 illustrates a fluid tank 1 connected by an outlet pipe 3 to a distributor pipe 2 which runs through all the treatment points of the texturing machine. The required quantity of water is fed to the tank 1 through a further pipe 4, in which a flow regulator 5 is located. The fluid level 1' in the tank 1 can be read off on a scale 6.

At each yarn treatment point a feed pipe 7 leads from the distributor pipe 2 to an appropriate moistening device 8. All the moistening devices 8 are located at an equal height, so that all the pipes 7 are of the same length.

As can be seen from FIG. 2, the moistening device 8 is composed of a housing 9 with a cylindrical bore 10, into which a die 11 is sealingly inserted. In the housing 9 there is a hollow space 12 which continues into the die 11. The liquid inlet pipe 7 opens into this space 12 and from the space 12 a bore 13 leads to a liquid outlet point 13', which is in contact with a yarn 14 being treated. The end part of the bore 13 opens out conically. The die 11 has a notchlike incision 11' to guide the yarn 14, as can be seen from FIG. 3.

Referring again to FIG. 1, each yarn 14 which is led from the top to the bottom through a treatment point of the machine, passes to an air texturing jet 15, after passing through the moistening device 8. The yarn is textured, in a manner which is not illustrated, in a vortex chamber of the texturing jet, and passes from there to further treatment units which are also not shown.

When the texturing machine is put into service, water is firstly allowed to run into the tank 1, the flow of water being adjusted with the aid of the flow regulator 5, so as to regulate both the liquid level 1′ which is suitable for the titre and rate of flow of the yarn being treated, and also the throughput of liquid through each bore 13 which is required.

The height h of the fluid level 1′ in the tank 1 as a function of the volume current in each one of the feed pipes 7 can be calculated by means of the Bernoulli equation, assuming that the pressure $p_1$ of the fluid in the tank 1 is equal to the pressure $p_2$ of the fluid at the outlet aperture 13′ of the bore 13.

Hence:

$$\rho \cdot g \cdot h = \rho \cdot \frac{v^2}{2} + P_{vI\text{-}2}$$

$$\text{where } P_{v1-2} = k \cdot \rho \cdot \frac{v^2}{2}$$

$$\text{and } v = \frac{\dot{q}_v}{A}$$

$$\text{Thus } h_1 = \frac{\dot{q}_v 2}{2 \cdot g \cdot A^2} (1 + k)$$

In the above:

$q_v$ indicates the desired volume current in a feed pipe 7, whose value is determined by the titre and rate of flow of the yarn which is being treated.

A indicates the cross-section of the outlet aperture 13′ g indicates the acceleration due to gravity $\rho$ indicates the density of the fluid v indicates the rate of outflow of the fluid at the aperture 13′ k indicates the total resistance figure for the distributor pipe and all the other parts of the pipeline reduced to v.

By suitable selection of the cross-section A of the outlet aperture 13′ of the bore 13 in the moistening devices 8, it is possible to ensure that the height h of the fluid level 1′ reaches at least 30 mm. By this means, any minimal differences in the positions of the bores 13 occurring during assembly of the individual moistening devices 8 of the machine will not exercise an unfavourable effect, i.e. the creation of an uneven yarn texturing effect resulting from variable covering of the threads with water at the various treatment points of the machine.

I claim:

1. A process for moistening a plurality of textile yarns prior to texturing of the yarn by means of pressurized gas from a jet, comprising charging a plurality of moistening devices from a liquid tank, the moistening devices each comprising a die defining a longitudinal bore therein, and an outlet aperture in the front face of the die past which the yarn is led, and regulating the quantity of fluid fed to the tank by means of a flow regulator which is adjusted to provide a predetermined quantity of fluid corresponding to a throughput of fluid through the bore of each die which is matched to the titre and the speed of passage of the yarns.

2. A process according to claim 1, wherein the liquid level in the tank is maintained at a height of at least 30 mm.

* * * * *